US005160871A

United States Patent [19]

Tomii et al.

[11] Patent Number: 5,160,871

[45] Date of Patent: Nov. 3, 1992

[54] FLAT CONFIGURATION IMAGE DISPLAY APPARATUS AND MANUFACTURING METHOD THEREOF

[75] Inventors: Kaoru Tomii, Isehara; Akira Kaneko, Tokyo, both of Japan

[73] Assignee: Matsushita Electric Industrial Co., Ltd., Osaka, Japan

[21] Appl. No.: 536,849

[22] Filed: Jun. 12, 1990

[30] Foreign Application Priority Data

Jun. 19, 1989 [JP] Japan ..... 1-156451
Aug. 5, 1989 [JP] Japan ..... 1-203382

[51] Int. Cl.[5] ..... G09G 1/04; H01J 29/70
[52] U.S. Cl. ..... 315/366; 313/422
[58] Field of Search ..... 315/366; 313/422

[56] References Cited

U.S. PATENT DOCUMENTS 3,665,241 5/1972 Spindt et al. ..... 313/351
4,575,765 3/1986 Hirt ..... 358/230
4,857,799 8/1989 Spindt et al. ..... 313/495
4,908,539 3/1990 Meyer ..... 315/169.3

FOREIGN PATENT DOCUMENTS 234989 9/1987 European Pat. Off. .
61-221783 10/1986 Japan .
8505491 12/1985 PCT Int'l Appl. ..... 315/366

OTHER PUBLICATIONS

Patent Abstracts of Japan, vol. 12, No. 355 (E-661) (3202), Sep. 22, 1988; and JP-A-63 110 530 (Matsushita Electric Ind., Co., Ltd.) May 16, 1988.
"Field-Emitter Arrays Applied to Vacuum Fluorescent Display" by Spindt et al.; IEEE Transactions on Electron Devices, vol. 36, No. 1, Jan. 1989 pp. 225-228.
"Advanced Technology: Flat Cold-Cathode CRTs" by I. Brodie; Information Display Jan. 1989, vol. 5, No. 1; pp. 17-19.

*Primary Examiner*—Gregory C. Issing
*Attorney, Agent, or Firm*—Lowe, Price, Leblanc & Becker

[57] ABSTRACT

A flat configuration image display apparatus electron beam generator equipped with cold cathodes for generating a plurality of electron beams in response to image signals fed from an image signal supply circuit, and electron beam control electrodes for selectively energizing the cold cathodes of the electron beam generator in accordance with a scanning line selection signal. The electron beam generator is further equipped with at least an array of n base electrodes extending in vertical directions of a screen of the image display apparatus where n is an integer equal to or greater than 3, and a predetermined number of the cold cathodes are disposed on each of the base electrodes. The image signals are independently applied through terminal leaders to the base electrodes, the terminal leaders being led up to outsides of a vacuum housing of the image display apparatus. The electron control electrodes are divided into a plurality of groups each of which are responsive to the scanning line selection signal through a common bus.

18 Claims, 8 Drawing Sheets

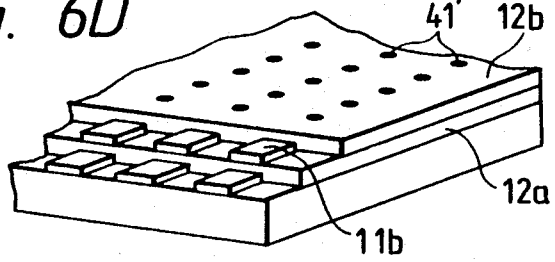
FIG. 6A
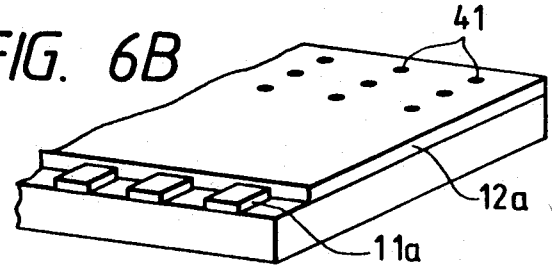
FIG. 6B
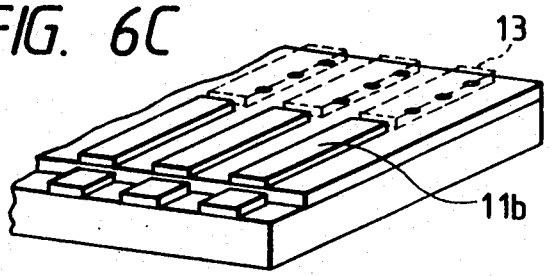
FIG. 6C
FIG. 6D
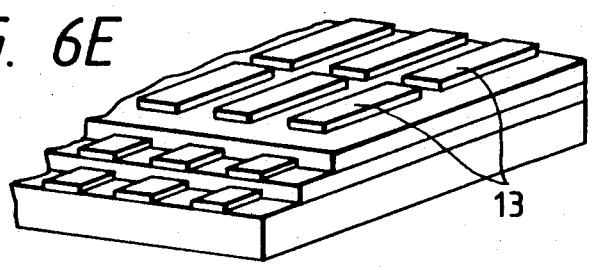
FIG. 6E
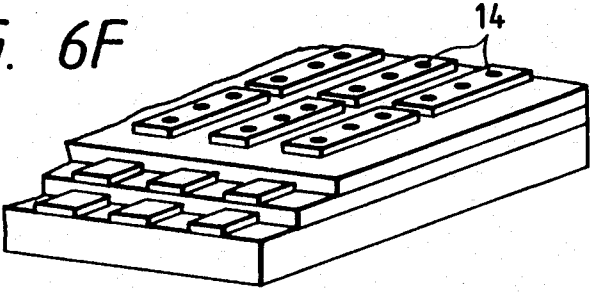
FIG. 6F

FLAT CONFIGURATION IMAGE DISPLAY APPARATUS AND MANUFACTURING METHOD THEREOF

BACKGROUND OF THE INVENTION

The present invention relates generally to a flat configuration image display apparatus, and more particularly to an image display apparatus based on a flat configuration cathode ray tube (which will be referred to as a CRT) for use in color television receivers, computer terminal displays and others and a manufacturing method of such an image display apparatus.

Recently, a flat configuration image display apparatus comprising a field-emitter type cold cathode has been developed and proposed, as exemplified by description in reports such as "IEEE Electron Device" (C. A. Spindt et al. IEEE Trans. ED, Vol.36, No. 1, 1989) and "Information Display" (I. Brodie, 17, 1989), the teachings of which will briefly be described hereinbelow with reference to FIGS. 1A and 1B. In FIGS. 1A and 1B, the flat-configuration display apparatus is composed of stripe-shaped base electrodes 102 formed on a silicon (Si) substrate 101 and gate electrodes 104 disposed to be substantially orthogonal with respect to the base electrodes 102 with an oxide insulating film 109 being interposed therebetween. At the cubically orthogonal positions of the base electrodes 102 and the gate electrodes 104 are formed cold cathodes 103 each having a structure as illustrated in FIG. 2. As illustrated in FIG. 1B, in one pixel, there are the three gate electrodes 104 which respectively face a faceplate 107 having thereon red-emission (R), green-emission (G) and blue-emission (B) fluorescent stripes 105. These fluorescent stripes 105 are disposed on an optically transparent conductive film (ITO) 106 which is formed on an inner surface of the faceplate 107. The faceplate 107 is spaced by a predetermined distance from the gate electrodes 104 by means of space pillars 108.

In the above-described arrangement, for displaying a television image, vertical scanning is made by successively applying a line selection pulse voltage for one horizontal scanning interval to the base electrodes 102, while in response to application of an image color signal to the gate electrodes 104 the cold cathodes 103 disposed at the orthogonal positions of both the electrodes 102 and 104 emit electron beams which in turn causes the fluorescent stripes 105 to radiate for image display. Each of the cold cathodes 103 has a cone configuration as illustrated in FIG. 2 and its tip is near the gate electrodes 104.

One aspect of the conventional flat configuration image display is, however, that the base electrodes continuously extend from the upper portion of the screen up to the lower portion thereof and the emission time of an electron beam from the cold cathode per one horizontal scanning in the standard television system, i.e., the duty cycle, becomes 1/525. Thus, for indication of a bright image, each of the cold cathodes is required to emit a great amount of electron beam, and this can reduce the life of the cold cathodes concurrently with increasing power consumption because of an increase in the amplitude of the image color signal required to be applied to the base electrode. Another problem arising with the conventional flat configuration image display apparatus is that, since electron beams from the cold cathodes are directly incident on the fluorescent stripes and hence the gate electrodes are arranged to be in close proximity to the flourescent stripes, difficulty is encountered to apply a high voltage to the fluorescent stripes because of occurrence of discharging. The difficulty of the high-voltage application causes difficulty of display of a bright image.

SUMMARY OF THE INVENTION

The present invention has been developed in order to eliminate the problems inherent to the conventional flat configuration image display apparatus.

It is therefore an object of the present invention to provide a flat configuration image display apparatus which is capable of improving the drive efficiency of the cold cathodes and further of improving the image quality.

In accordance with the present invention, there is provided a flat configuration image display apparatus comprising electron beam generation means having cold cathodes for generating a plurality of electrom beams in response to image signals fed from an image signal supply circuit, electron beam control electrode means for selectively energizing the cold cathodes of the electron beam generation means in accordance with a scanning line selection signal from a selection signal generation circuit, and fluorescent film means having a fluorescent surface which radiates in response to the plurality of electron beams from the electron beam generation means, the electron beam generation means being equipped with at least an array of n base electrodes extending in vertical directions of a screen of said image display apparatus where n is an integer equal to or greater than 3, and said image signals being independently applied to the n base electrodes of the electron beam generation means.

Preferably, the electron beam control electrode means comprises stripe-like electrodes whose number is equal to the number of the horizontal scanning lines for display of an image and which are successively arranged with a predetermined pitch in the vertical directions of the screen of the image display apparatus so as to be in cubically orthogonal relation to the n base electrodes of the electron beam generation means, the stripe-like electrodes being divided into groups each of which are connected to a common bus which receives the scanning line selection signal from the selection signal generation circuit. The n base electrodes are electrically led through terminal lead means up to an outside of a vacuum housing of the image display apparatus. Moreover, the terminal lead means comprises a plurality of laminated members which are successively arranged with a predetermined pitch in correspondance with the base electrodes of the electron beam generation means in the horizontal directions of the screen of said image display apparatus and each of which comprises a plurality of conductive layers overlapped with insulating members being interposed therebetween, each of the plurality of conductive layers being electrically coupled to a corresponding base electrode.

In accordance with the present invention, there is further provided a method of manufacturing a flat configuration image display apparatus, the method comprising the steps of: forming a first terminal lead layer, made of a conductive material, on a surface of a substrate made of an insulating material; forming a first insulating layer to cover portions other than end portions of the first terminal lead layer; forming a second terminal lead layer on the first insulating layer so that the second terminal lead layer is disposed on the first terminal lead layer with the first insulating layer being interposed therebetween; forming a second insulating layer to cover portions other than end portions of the second terminal lead layer; and forming electrode layers on the second insulating layer so that each of the electrode layers is electrically coupled to the corresponding terminal lead layer.

In accordance with the present invention, there is still further provided a flat configuration image display apparatus comprising electron beam generation means having cold cathodes for generating a plurality of electrom beams in response to image signals fed from an image signal supply circuit; electron beam control electrode means for selectively energizing the cold cathodes of the electron beam generation means in accordance with a scanning line selection signal from a selection signal generation circuit; electron beam extraction means for extracting the plurality of electron beams from the electron beam generation means; focusing electrode means for focusing the electron beams extracted by the electron beam extraction means; and fluorescent film means having a fluorescent surface which radiates for display of an image on a screen of the image display apparatus in response to the plurality of electron beams focused by the focusing electrode means.

BRIEF DESCRIPTION OF THE DRAWINGS

The object and features of the present invention will become more readily apparent from the following detailed description of the preferred embodiments taken in conjunction with the accompanying drawings in which:

FIGS. 6A to 6F are illustrations for describing a method of manufacturing the FIG. 3 flat configuration image display apparatus;

DETAILED DESCRIPTION OF THE INVENTION

Figure 1A:
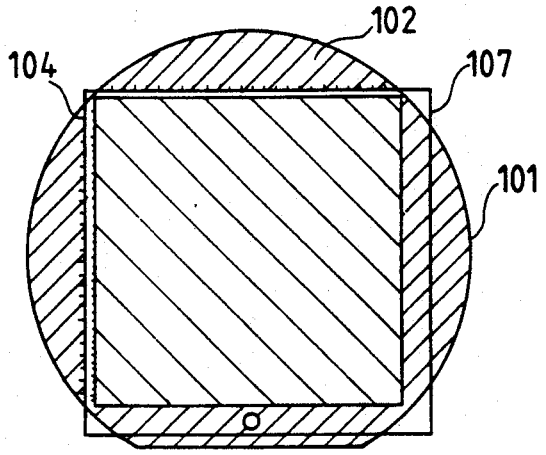
FIG. 1A PRIOR ART
FIGS. 1A, 1B and 2 are illustrations for describing a conventional flat configuration image display apparatus.
Figure 1B:
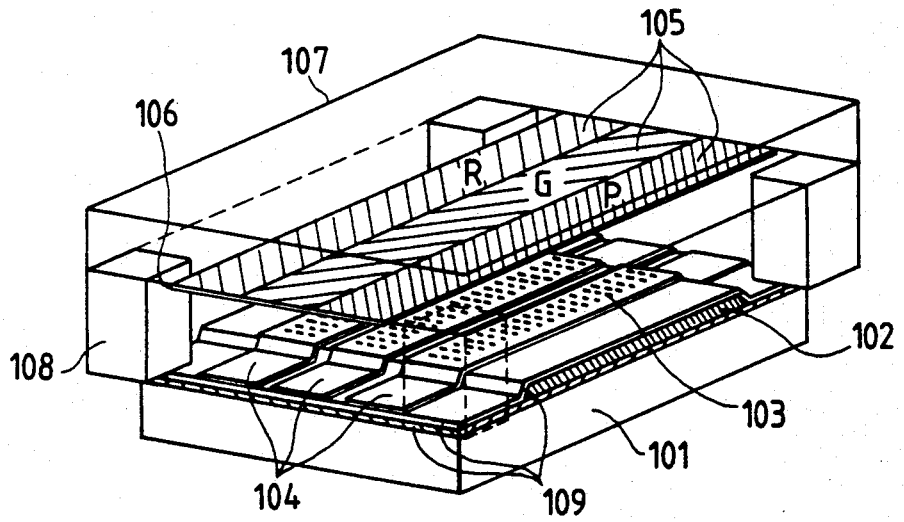
FIG. 1B PRIOR ART
Figure 2:
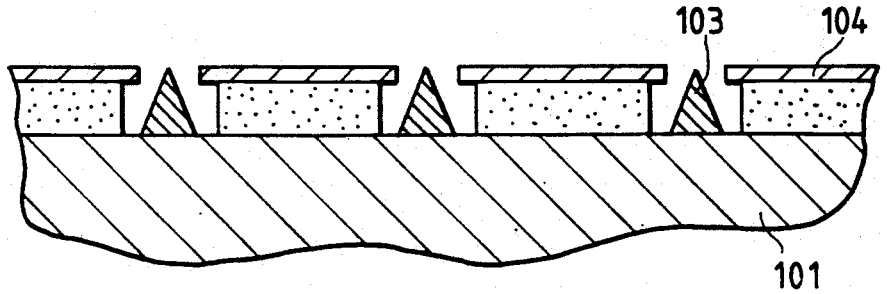
FIG. 2 PRIOR ART
Figure 3:
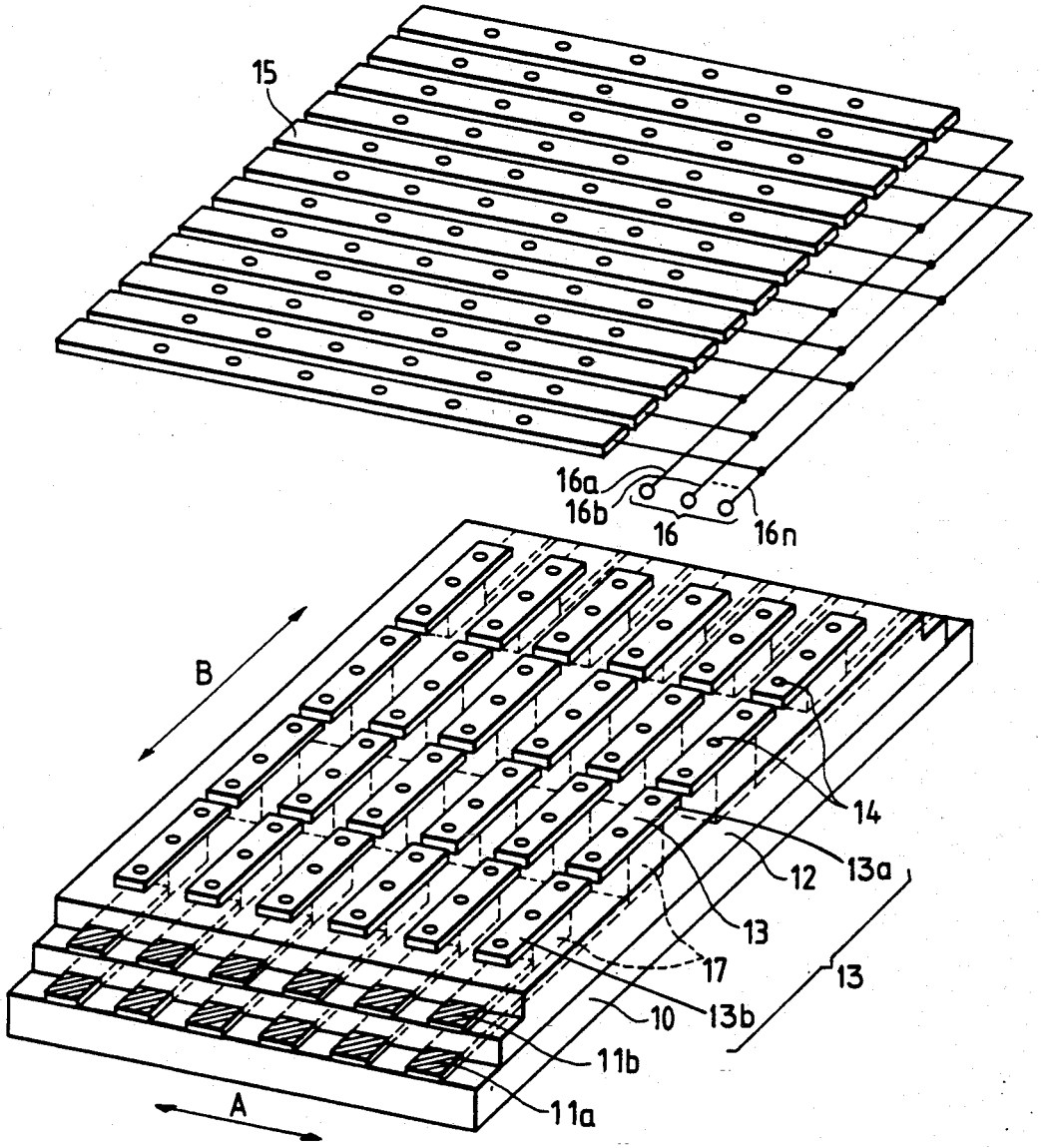
FIG. 3 is a perspective view showing an arrangement of an electron beam generation section of a flat configuration image display apparatus according to a first embodiment of the present invention.

Referring now to FIG. 3, there is illustrated an electron beam emission section of a flat configuration image display apparatus according to a first embodiment of the present invention. Parts other than the electron beam emission section have the same arrangement as the above-described conventional flat configuration image display apparatus and are omitted in the illustration for brevity. In FIG. 3, on an insulating substrate 10 made of a glass, for example, are provided film-like terminal lead members 11*a*, 11*b*, an insulating layer 12 having through-holes or apertures, base electrodes 13 responsive to image signals from an external circuit, and cold cathodes 14 for producing electron beams in response to the image signals. The base electrodes 13 are electrically coupled through conductive members 17 to the terminal lead members 11*a* or 11*b*, respectively. That is, for example, the base electrode 13*a* is coupled to the terminal lead member 11*a* and the base electrode 13*b* is coupled to the terminal lead member 11*b*. The cold cathodes 14 are constructed on the base electrodes 13 and disposed to be in spaced and confronting relation to gate electrodes 15 which are successively arranged in the vertical directions (arrow B) of the screen of the image display apparatus for switching the scanning line. Each of groups of the gate electrodes 15 is electrically connected to one (16*a*, 16*b*, . . . , or 16*n*) of common buses 16.

The terminal lead members 11*a* are succesively arranged or arrayed with a predetermined pitch in a horizontal directions indicated by an arrow A and extend from end portions of the insulating substrate 10 up to the center portions thereof. Other than end portions and connecting portions (formed to be holes) to the base electrodes 13, the terminal lead members 11*a* are covered by (embedded in) the insulating layer 12. The terminal lead members 11*b* whose lengths are shorter than the lengths of the terminal lead members 11*a* are further disposed at positions above the terminal lead members 11*b* so as to be electically insulated from the terminal lead members 11*a*. Similarly, other than end portions and connecting portions (formed as holes) to the base electrodes 13, the terminal lead members 11*b* are covered by the same insulating layer 12. At postions above a surface of the insulating layer 12 are disposed the base electrodes 13 each of which has a predetermined length (in this embodiment, about ¼ of the vertical distance of the image display screen) in vertical directions indicated by an arrow B and which are arranged so as to form vertical and horizontal rows. That is, for example, each of the horizontal rows comprises six base electrodes 13 successively arranged with the same pitch as the terminal lead members 11*a* or 11*b* in the horizontal directions indicated by the arrow A and each of the vertical rows comprises four base electrodes 13 successively arranged with a predetermined pitch in the arrow B vertical directions. The arrangement of the base electrodes 13 is symmetrical with respect to the center lines of the insulating substrate 10 in the arrow A horizontal directions or in the arrow B vertical directions. As described above, these base electrodes 13 are electrically coupled through the conductive members 17 to the terminal lead members 11*a* or 11*b*, respectively. On each of the base electrodes 13 are formed the cold cathodes 14 whose number is 3 in the illustration.

The gate electrodes 15 are disposed to be in spaced and confronting relation to the base-electrode plane and in cubically orthogonal relation thereto with an insulating member (not shown) being interposed therebetween. The gate electrodes 15 respectively have through-holes which are respectively arranged to be in confronting relation to the cold cathodes 14 constructed on the base electrodes 13. When the horizontal scanning line number effective to the NTSC standard television image is 480, the number of the gate electrodes 15 is 120 per one base electrode which are successively arranged with a predetermined pitch in the arrow B vertical directions. If numbering the gate electrodes 15 from the upper side to the lower side in the vertical directions, the first, 121th, 241th and 361th gate electrodes 15 are respectively connected to a common bus 16*a* and the second, 122th, 242th and 362th gate electrodes 15 are respectively connected to a common bus 16*b*. Similarly, the nth, (n+120)th, (n+240)th and (n+360)th gate electrodes 15 are connected to a common bus 16*n*. Here, n represents a positive integer below 120.

Figure 4:
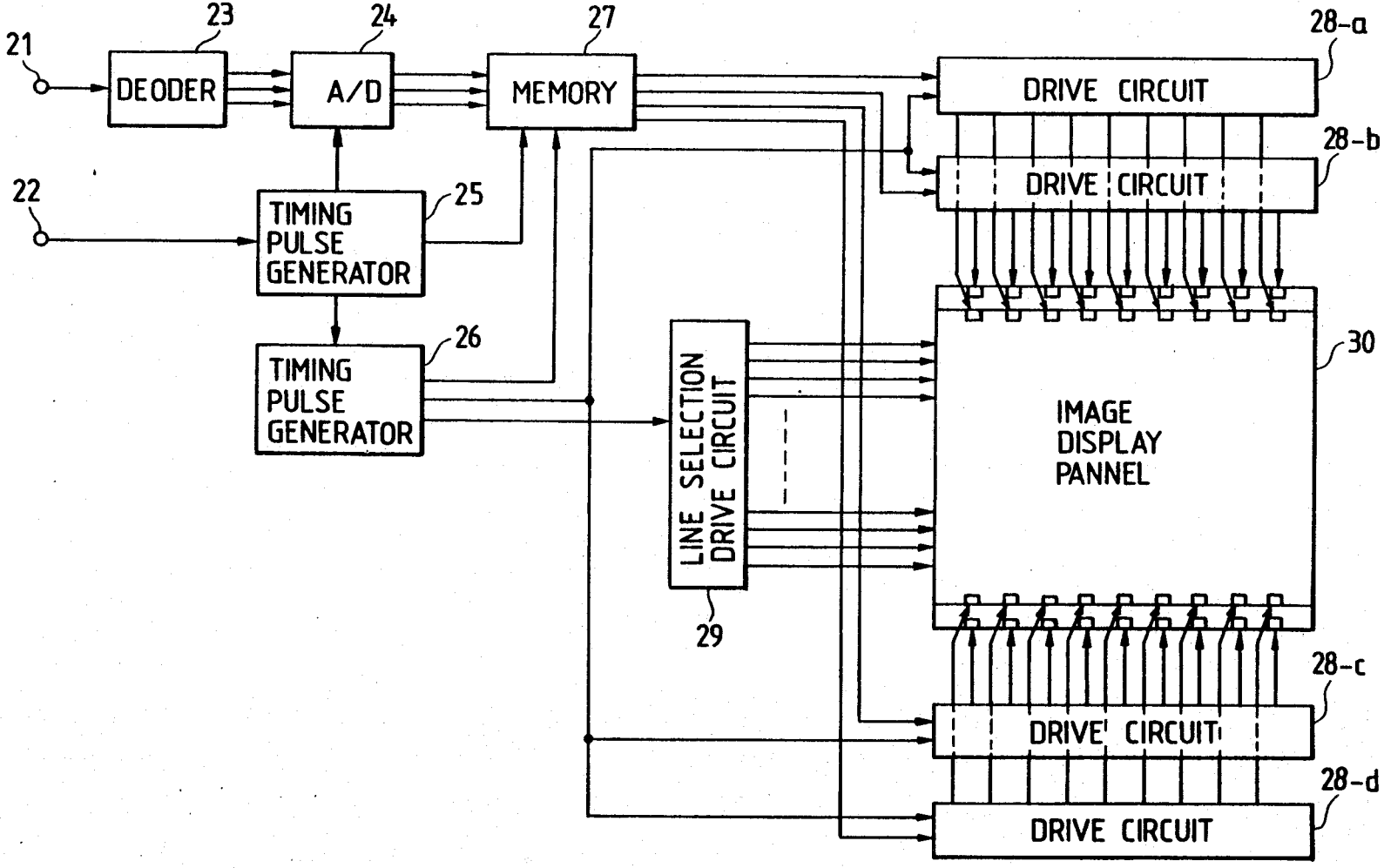
FIG. 4 is a block diagram showing a drive system of the FIG. 3 flat configuration image display apparatus.
Figure 5:
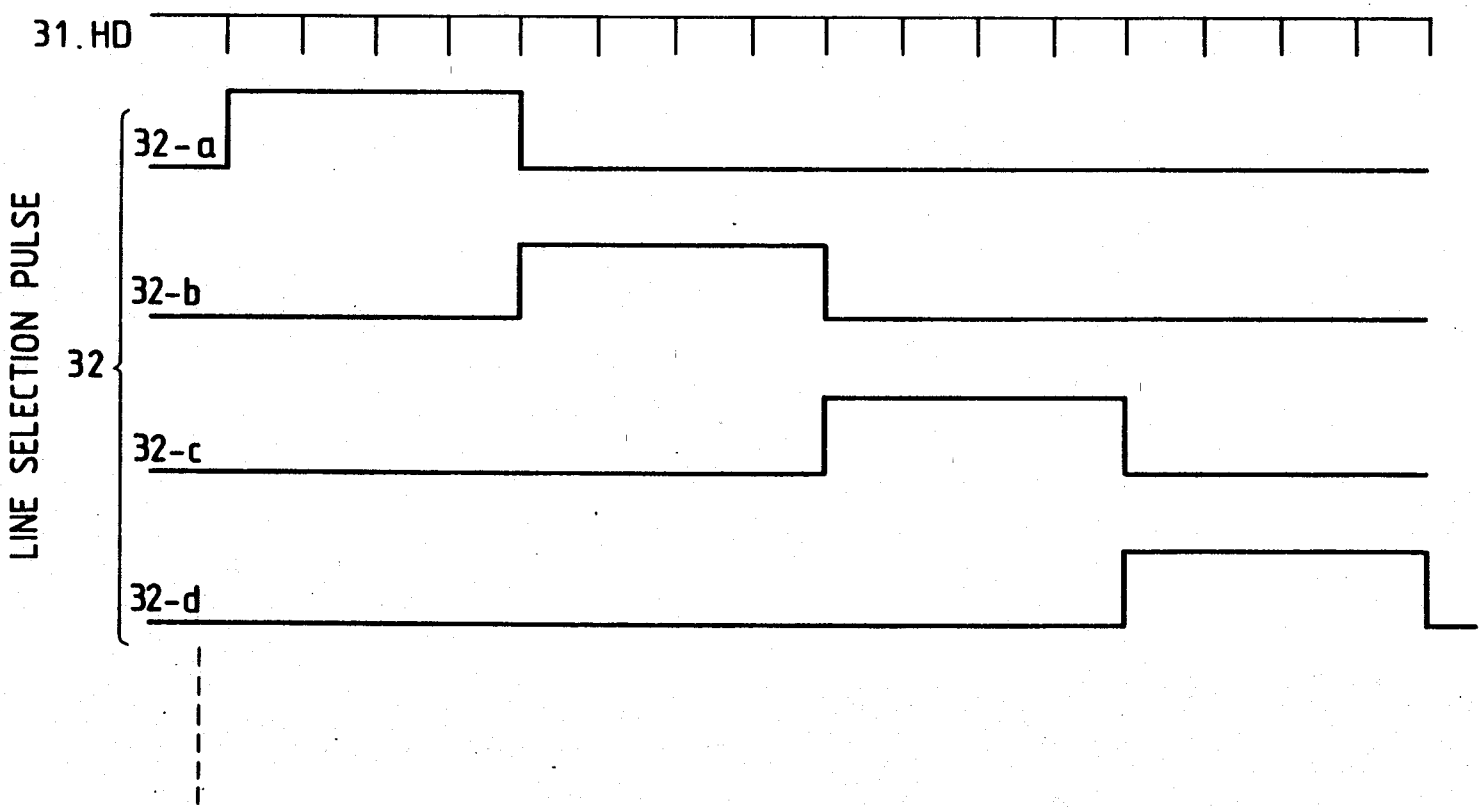
FIG. 5 is a timing chart for describing the operation of the FIG. 4 drive system.

A description will be made hereinbelow in terms of a drive system of a flat configuration image display apparatus with the above-described electron beam emission section in the case of displaying a television image with reference to FIGS. 4 and 5, a synchronizing signal is inputted through a terminal 22 into a writing timing pulse generator 25 which in turn produces control pulse signals for an analog-to-digital (A/D) converter 24, a frame memory 27 and a reading timing pulse generator 26. On the other hand, an image signal is inputted through a terminal 21 to a decoder 23 so as to separate the inputted image signal to red (R), green (G) and blue (B) original signals which are in turn supplied to the A/D converter 24, in which the red (R), green (G) and blue (B) original signals are respectively sampled in accordance with the control pulse signal from the timing pulse generator 25 and further converted into digital signals. The output signals of the A/D converter 24 are fed to the frame memory 27 so as to be stored for one field of the television image. In response to shift to the next field, the signals stored in the frame memory 27 are read out in accordance with the control signal from a control signal from the timing pulse generator 26 and then supplied to drive circuits 28-a to 28-d. That is, the image signals for the first, 61th, 121th and 181th horizontal scanning intervals (periods) are simultaneously supplied to the drive circuits 28-a to 28-d, respectively. Each of the drive circuits 28-a to 28-d converts the corresponding image signal into a pulse-width modulation signal or an analog signal and amplifies the converted signal which is in turn supplied to a terminal (11*a* or 11*b* in FIG. 3) of a flat configuration image display pannel 30. The time for the supply corresponds to four horizontal scanning intervals (4H). On the other hand, on the basis of a line selection control signal from the timing pulse generator 26, a line selection and drive circuit 29 supplies a line selection pulse signal (32-a in FIG. 5), having a voltage necessary for electron beam emission, to the common bus coupled to the first, 121th, 241th and 361th gate electrodes 15 during 4H. After elapse of 4H, the image signals for the next horizontal scanning intervals (2, 62, 122, 181) are read out from the frame memory 27 so as to be supplied to the drive circuits 28-a to 28-d, respectively. At this time, the line selection and drive signal produces a line selection pulse signal (32-b in FIG. 5) whose phase is shifted by 4H with respect to that of the above-mentioned line selection pulse signal (32-a in FIG. 5). The line section signal (32-b in FIG. 5) is supplied to the common bus coupled to the third, 123th, 243th and 363th gate electrodes 15. The first field image is displayed by performing similar operation. Here, for displaying the even-field image, as well as the above-described operation for the first field, the image signals are supplied to the flat configuration image display pannel 30. In this case, the line selection pulse signal is supplied to the common bus coupled to mth, (m+120)th, (m+240)th and (m+360)th gate electrodes 15. The character m represents a positive even number below 120. As a result, one-frame television image is displayed.

A description will be made hereinbelow in terms of a method of manufacturing the flat configuration image display apparatus illustrated in FIG. 3 with reference to FIGS. 6A to 6F. As illustrated in FIG. 6A, the terminal lead members 11*a* are formed, on the insulating substrate 10 made of a glass or others, by means of the screen printing technique, deposition technique or the like so as to be successively arranged in the horizontal direction with a predetermined pitch. The length of each of the terminal lead members 11*a* is determined to be about ½ of the vertical length of the image display area. Then, as illustrated in FIG. 6B, the surfaces of the formed terminal lead members 11*a* are covered by a film-like insulating member 12*a* which is made of a frit glass, for example. The film-like insulating member 12*a* is formed by means of the screen printing technique or others. At this time, portions of the terminal lead members 11*a* to be disposed to be outside a vacuum housing are not covered by the insulating member 12*a*. The insulating member 12*a*, having a predetermined thickness, is arranged to have through-holes 41 at predetermined positions which are on the terminal lead members 11*a*. Each of the through-holes 41, having a predetermined diameter, is occupied by an electrical conductive material such as a metal which comes into electrically contact with the corresponding terminal lead member 11*a*. Thereafter, as illustrated in FIG. 6C, the terminal lead members 11*b* are formed on the insulating member 12*a* so as to be above the terminal lead members 11*a*. Each of the terminal lead members 11*b* has a length which is about ½ of the length of each of the terminal lead members 11*a*. At this time, it is also appropriate that the above-mentioned conductive material is screen-printed in the through-holes 41. At this stage, if required, it is appropriate to form the base electrodes 13 indicated by dotted lines which are electrically coupled through the conductive material to the terminal lead members 11*a*. In this case, this process is followed by a process illustrated in FIG. 6F which will be described hereinafter.

After the process of FIG. 6C, a process is performed as illustrated in FIG. 6D, where a film-like insulating member 12*b* is further formed so as to cover the terminal lead members 11*b*. As well as the terminal lead members 11*a*, portions of the terminal lead members 11*b* are arranged so as not to be covered by the insulating member 12*b* and the insulating member 12*b* has through-holes 41' which are positioned on the above-mentioned through-holes 41 and further on the terminal lead members 11*b*. These through-holes 41' are similarly filled with conductive materials which are in turn coupled electrically to the terminal lead members 11*a* and 11*b*. The base electrodes 13 are arranged on the insulating member 12*b* so as to cover the through-holes 41' as illustrated in FIG. 6E. Hence, each of the base electrodes 13 are electrically coupled through the conductive material to each of the terminal lead members 11*a* or 11*b*. Thereafter, the cold cathodes 14 are formed on the base electrodes 13 as illustrated in FIG. 6F. The forming of the cold cathodes 14 on the base electrodes 13 may be performed by the conventional technique.

Although in the above description the terminal lead members 11*a* and 11*b* are constructed as laminated structures, it is appropriate that the terminal lead members 11*a* and 11*b* are shifted by a predetermined length from each other in the directions normal to the laminating directions. This can reduce the electrostatic capacity between the terminal lead members 11*a* and 11*b*.

Figure 7:
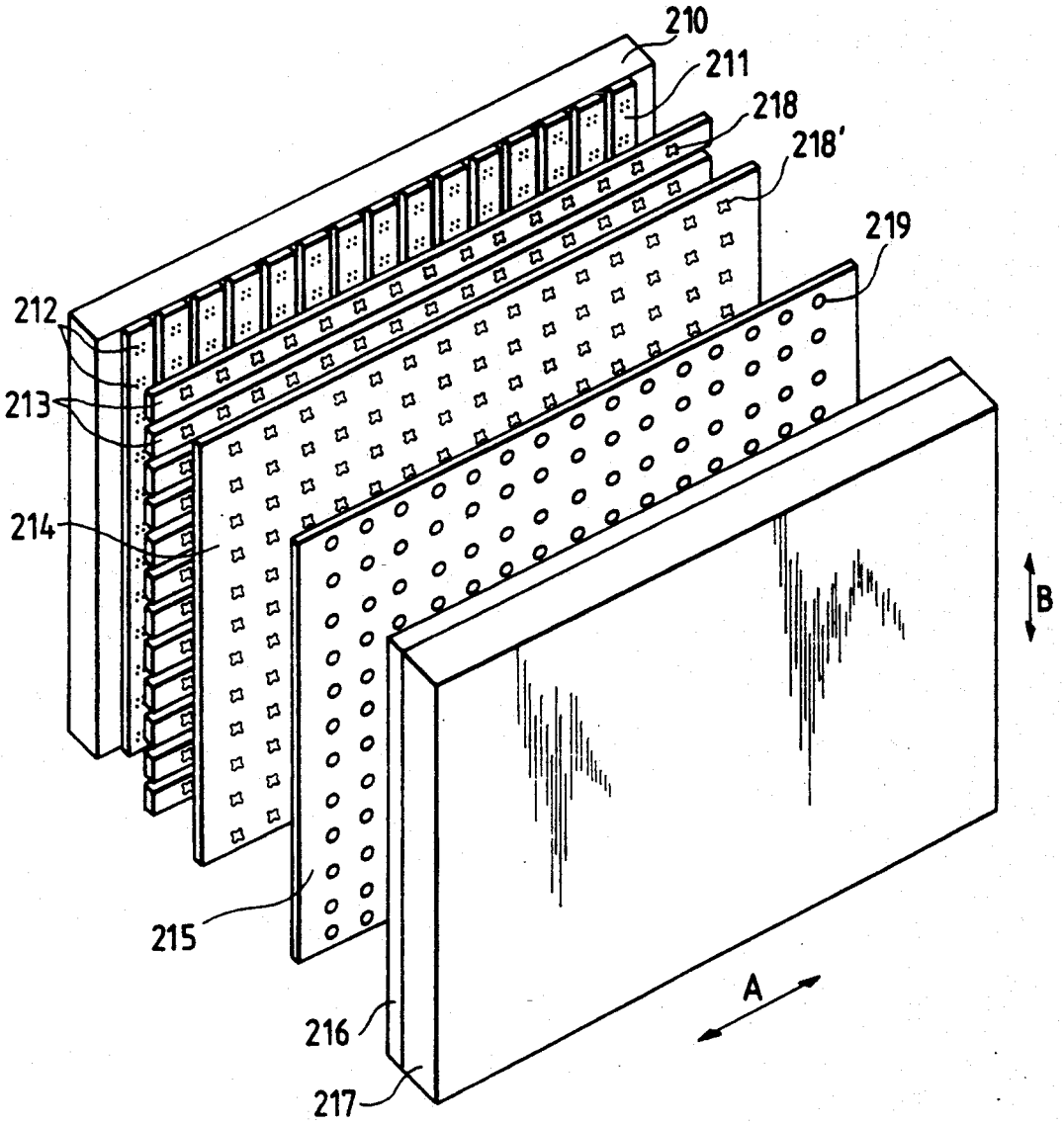
FIG. 7 is a perspective view showing a flat configuration image display apparatus according to a second embodiment of this invention.
Figure 8:
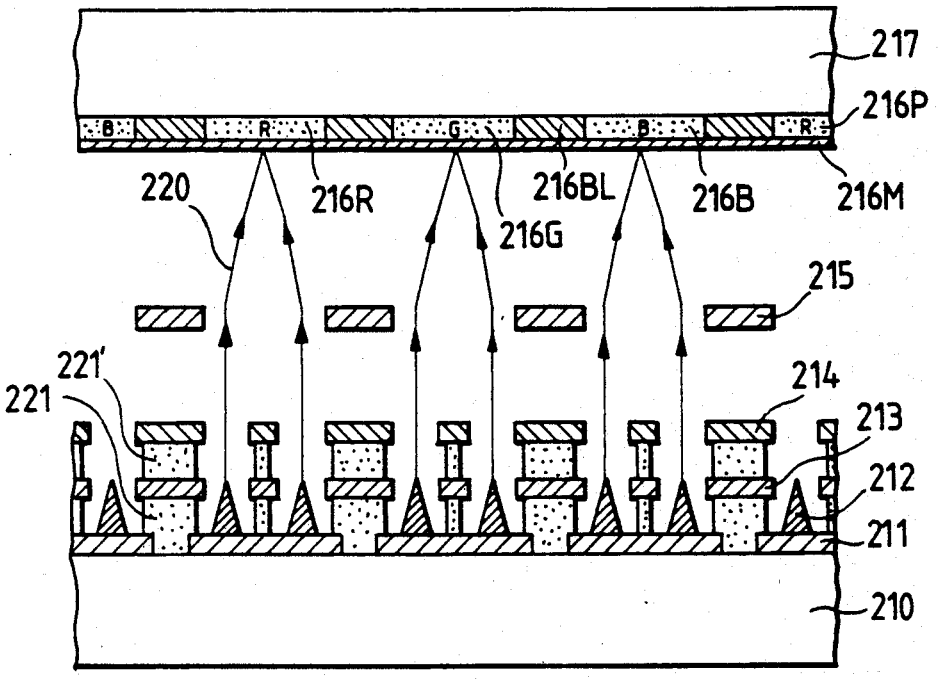
FIG. 8 is a cross-sectional illustration of the FIG. 7 image display apparatus.

A second embodiment of this invention will be described hereinbelow with reference to FIGS. 7 and 8. FIG. 7 shows an arrangement of a flat configuration image display apparatus of the second embodiment where a vacuum housing is not illustrated, and FIG. 8 shows a cross-section of the FIG. 7 image display apparatus in a horizontal direction (arrow A) of the screen thereof. The description of parts corresponding to those in the FIG. 3 image display apparatus or conventional image display apparatus will be omitted for brevity. In FIGS. 7 and 8, the image display apparatus similarly includes base electrodes 211 formed on a substrate 210 and cold cathodes 212 formed on the base electrodes 211. The base electrodes 211 have the same stripe configuration extending in the vertical directions (arrow B) and are successively arranged in the horizontal direction (arrow A) to be parallel to each other with a predetermined pitch. Electron beam control electrodes (gate electrodes) 213, having the same stripe configuration extending in the horizontal direction, are successively arranged with a predetermined pitch in the vertical direction so as to be substantially orthogonal with respect to the base electrodes 211. The electron beam control electrodes 213 are disposed so as to be in opposed relation to the base electrodes 211 with insulating members 221 being interposed therebetween. On portions of the base electrodes 211 corresponding to the cubically orthogonal positions of both the electrodes 211 and 213 are formed the cold cathodes 212 each of which may have the same structure as that of the conventional image display apparatus. Further, at portions of the electron beam control electrodes 213 which substantially face the cold cathodes 212 on the base electrodes 211 are formed through-holes (apertures) 218 each of which has a predetermined size substantially corresponding to an area of some of the cold cathodes 212 and each of which is positioned in correspondance with each of the cold cathodes 212. The numbers of the base electrodes 211 and the electron beam control electrodes 213 will be determined in accordance with the application of the image display apparatus.

Also included in the image display apparatus is an electron beam extraction electrode 214 which is disposed to be in opposed and spaced relation to the electron beam control electrodes 213. The electron beam extraction electrode 214 is spaced by a predetermined distance therefrom with insulating members 221' being interposed therebetween, and has therein through-holes (apertures) 218' which are at least the same size as the through-holes 218 of the electron beam control electrodes 213. Further, included in the image display apparatus is a focusing electrode 215 which is disposed to be in opposed and spaced relation to the electron beam extraction electrode 214. The focusing electrode 215 has through-holes 219 at portions facing the orthogonal positions of the base electrodes 211 and the electron beam control electrodes 213, each of the through-holes 219 having a size greater than an area occupied by a plurality of the cold cathodes 212. Still further, a transparent plate 217 (faceplate) made of a glass or the like and making up a portion of the vacuum housing is disposed to be in opposed and spaced relation to the focusing electrode 215. On the inner surface of the transparent plate 217 is formed a fluorescent member 216 composed of a fluorescent film 216P and a metal-backed film 216M. The fluorescent film 216P comprises red (R), Green (G) and blue (B) fluorescent sections 216R, 216G and 216B which are repeately arranged in the horizontal direction to be parallel to each other with black guard bands 216BL being interposed therebetween. The R, G and B fluorescent sections 216R, 216G and 216B are positioned so as to face the base electrodes 211.

A description will be made hereinbelow in terms of operation of the flat configuration image display apparatus. Image signals are applied to the base electrodes 211 and vertical scanning signals are applied to the electron beam control electrodes 213. At the time, the cold cathodes 212 emit electron beams toward the fluorescent film 216P which in turn radiates. When an ON voltage is applied to the electron beam control electrodes 213, a voltage is applied to the electron beam extraction electrode 214 so that the electric field strength becomes $10^7$ V/cm, for example, at the vicinity of the tips of the cold cathodes 212. The electron beam extraction electrodes 214 is disposed to be in close proximity to the cold cathodes 212 with the insulating members 221 which is formed on the electron beam control electrodes 213 by means of the thin-film forming technique or the like being interposed between the electron beam control electrodes 213 and the electron beam extraction electrode 214. Because the electron beam extraction electrodes 214 are brought closer to the cold cathodes 212, interposing the insulating members 221 therebetween makes the separations therebetween uniform. This structure thus makes it possible to lower the voltage to be applied to the electron beam extraction electrodes 214 as compared with the conventional apparatus.

Each of the through-holes 219 of the focusing electrode 215 acts as a large-sized electrostatic focusing lens whereby the electron beams emitted from a given number of the cold cathodes 212 are focused on a point of the fluorescent member 216 formed on the inner surface of the transparent plate 217. To the focusing electrode 215 is applied a voltage by which the electron beams 220 emitted from the cold cathodes 212 whose number is determined in correspondance with the through-holes 219 form a small spot on the fluorescent member 216. This application voltage is determined in accordance with the voltage to be applied to the fluorescent member 216 and the distances between the focusing electrode 215, the electron beam extraction electrode 214 and the fluorescent member 216.

Figure 9:
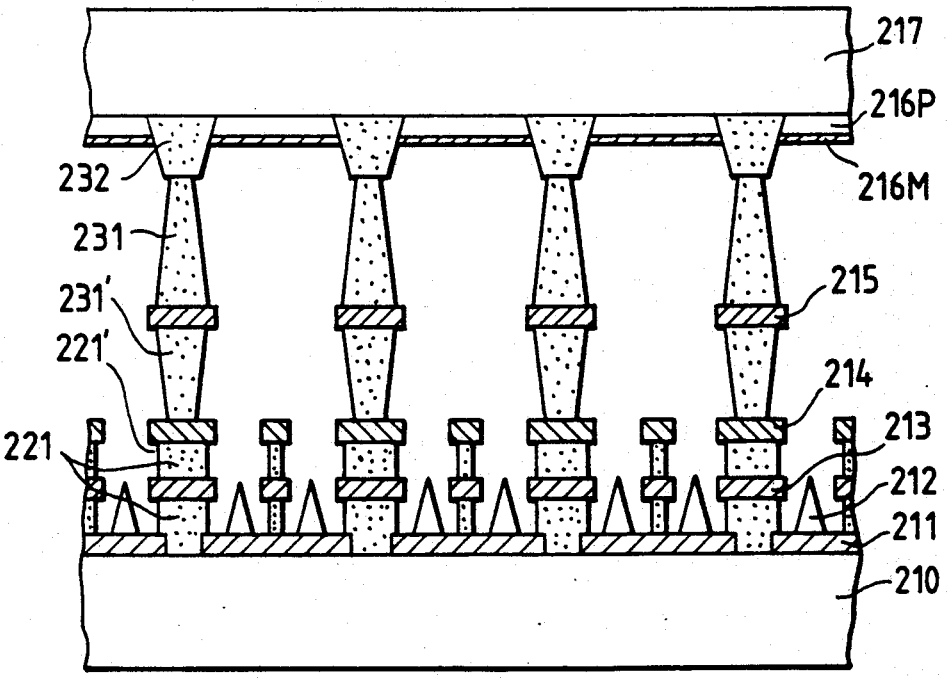
FIGS. 9 and 10 are cross-sectional illustrations for describing a flat configuration image display apparatus according to a third embodiment of the present invention and further describing a modification of the third embodiment.

A third embodiment of this invention will be described hereinbelow with reference to FIGS. 9 and 10. In connection with the vacuum proof strength in the case of enlarging the screen size of the FIG. 7 flat configuration image display apparatus, as illustrated in FIG. 9, integrally constructed are the insulating substrate 210, th electron beam extraction electrode 214, the focusing electrode 215 and the faceplate 217. Between the focusing electrode 215 and the fluorescent member 216 are provided insulating members 231 and 232 and between the focusing electrode 215 and the electron beam extraction electrode 214 is provided insulating members 231' whose structure is substantially the same as the aforementioned insulating members 231. That is, each of the insulating member 232, made of a back frit (glass) or other insulating materials, is formed on a surface of the faceplate 217 so as to have a stripe configuration and the fluorescent film 216P and the metal-backed film 216M are formed at portions other than the insulating member 232 positions of the surface of the faceplate 217. Further, the insulating members 231 and 231' are formed on both surface of the focusing electrode 215 by means of the screen printing technique so as to have predetermined thicknesses, the insulating members 231 being directly and coaxially connected to the insulating members 232. This arrangement can prevent damages of the fluorescent film 216P due to the insulating members 231.

Figure 10:
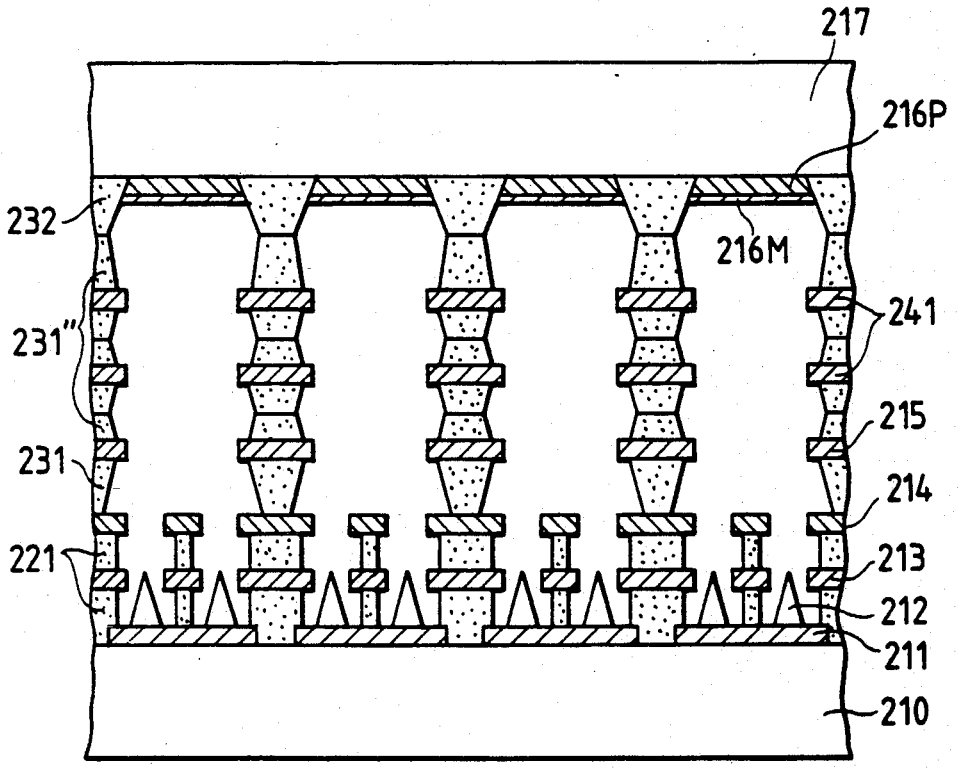

Here, for increasing the voltage to be applied to the fluorescent film 216 to obtain a brighter image, electrodes 241 corresponding to the focusing electrode 215 are provided between the focusing electrode 215 and the fluorescent film 216P as illustrated in FIG. 10. In this case, between the electrodes 241 and between the uppermost electrode 241 and the insulating members 232 are provided insulating members 231'' whose structure is the substantial same as the above-mentioned insulating members 231 or 231'. With this arrangement, a higher voltage is applied to the electrode 241 which is closer to the fluorescent film 216P. This can reduce the voltage difference between the respective electrodes to increase the voltage to be applied to the fluorescent film 216P.

According to the above-described embodiments, since the base electrode is divided into n (n: an integer equal to or greater than 3) in the vertical direction of the screen and signals are independently applied to the divided base electrodes, it is possible to improve n times as much as the duty of the operating time of each of the cold cathodes to indicate an image, whose brightness is the same as the image of the conventional flat configuration image display apparatus, with an electron beam amount which is 1/n of the electron beam amount of the conventional image display apparatus. Thus, the amplitude of the image signal can be made smaller and futher the power consumption can be reduced. In addition, since the electron beam extraction electrode having the through-holes at positions corresponding to the positions of the cold cathodes is disposed to be in close proximity to the cold cathodes, it becomes possible to effectively derive the electron beam with a lower voltage. Further, since the focusing electrode has through-holes each having a size corresponding to an area of a plurality of the cold cathodes, it is possible to obtain a microscopic electron beam spot on the fluorescent member. Still further, unlike the conventional flat configuration image display apparatus, the embodiment of the present invention is arranged such that the electron beam extraction electrode and the fluorescent surface electrode are separately disposed, whereby a higher voltage can be applied to the fluorescent surface electrode so as to obtain a brighter image.

It should be understood that the foregoing relates to only preferred embodiments of the invention, and that it is intended to cover all changes and modifications of the embodiments of the invention herein used for the purposes of the disclosure, which do not constitute departures from the spirit and scope of the invention. For example, although in the above description the flat configuration image display apparatus has the arrangement in which four base electrodes 13 are successively arranged in the vertical directions, this invention is not limited to such an arrangement.

What is claimed is:

1. A flat configuration image display apparatus comprising electron beam generation means having cold cathodes for generating a plurality of electron beams in response to image signals fed from an image signal supply circuit, electron beam control electrode means for selectively energizing said cold cathodes of said electron beam generation means in accordance with a scanning line selection signal from a selection signal generation circuit, and fluorescent film means having a fluorescent surface which radiates in response to the plurality of electron beams from said electron beam generation means, said electron beam generation means being equipped with at least a plurality of base electrodes extending in a vertical direction of a screen of said image display apparatus, each base electrode including n base electrode segments where n is an integer equal to or greater than 3, and said image signals being independently applied to said n base electrode segments of said electron beam generation means.

2. A flat configuration image display apparatus as claimed in claim 1, wherein said electron beam control electrode means comprises stripe-like electrodes whose number is equal to the number of the horizontal scanning lines for display of an image and which are successively arranged with a predetermined pitch in the vertical direction of said screen of said image display apparatus so as to be in cubically orthogonal relation to said n base electrode segments of said electron beam generation means, said stripe-like electrodes being divided into n groups each of which are connected to a common bus which receives said scanning line selection signal from said selectron signal generation circuit.

3. A flat configuration image display apparatus as claimed in claim 1, wherein said n base electrode segments are electrically led through terminal lead means up to an outside of a vacuum housing of said image display apparatus.

4. A flat configuration image display apparatus as claimed in claim 3, wherein said terminal lead means comprises a plurality of laminated members which are successively arranged with a predetermined pitch in correspondence with said base electrodes of said electron beam generation means in the horizontal direction of said screen of said image display apparatus and each of which comprises a plurality of overlapping conductive layers with insulating members being interposed therebetween, each of said plurality of conductive layers being electrically coupled to a corresponding base electrode segment.

5. A flat configuration image display apparatus as claimed in claim 4, wherein said plurality of conductive layers of each of said laminated members of said terminal lead means are shifted by predetermined lengths from each other in directions normal to the laminating directions of said plurality of conductive layers.

6. In a flat panel color display apparatus including an array of cold cathodes, a first set of stripe shaped base electrodes oriented in a first direction for receiving an image signal, a second set of stripe shaped gate electrodes oriented in a second direction orthogonal to said first direction for receiving a line selection pulse, wherein cold cathodes adjacent an orthogonal intersection of gate and base electrodes emit an electron beam towards a fluorescent film upon simultaneous reception of said selection pulse and said image signal by the gate and base electrodes at said orthogonal intersection, said fluorescent film divided into groups of stripes including a plurality of stripes for pixels of the display, said base electrodes arranged in groups corresponding to said groups of stripes for causing said cold cathodes to emit electrons towards fluorescent stripes responsive to image signals representing specified color information, the improvement comprising:

a structure for increasing duty cycle of a display element, wherein:

each of said base electrodes includes a plurality of n electrically isolated segments wherein n is an integer greater than 2, said gate electrodes are divided to n interspersed groups, and including a plurality of n buses each respectively connected to one of said n groups of gate electrodes, thereby enabling each of said segments of said base electrodes to cause said cold cathodes to emit electrons with an increased duty cycle.

7. The improved flat panel color display apparatus of claim 6, wherein n successive gate electrodes overlying one of said n segments of a base electrode are connected to different ones of said n bases.

8. The improved flat panel color display apparatus of claim 6 further comprising n lead terminals connecting to said n segments of each base electrode, said lead terminals including a plurality of laminated members successively arranged with a predetermined pitch in said second direction corresponding to said base electrodes, each member comprising a plurality of overlapped conductive layers having insulating members interposed therebetween, each of said plurality of conductive layers being electrically coupled to a corresponding base electrode segment.

9. The improved flat panel color display apparatus of claim 8, wherein terminal ends of said plurality of conductive layers of each laminated member are shifted by predetermined lengths in said first direction relative to each other.

10. A flat configuration image display apparatus comprising electron beam generation means having cold cathodes for generating a plurality of electron beams in response to an image signal fed from an image signal supply circuit; electron beam control electrode means for selectively energizing said cold cathodes of said electron beam generation means in accordance with a scanning line selection signal from a selection signal generation circuit; electron beam extraction means for extracting the plurality of electron beams from said electron beam generation means; focusing electrode means for focusing the electron beams extracted by said electron beam extraction means; and fluorescent film means having a fluorescent surface which radiates for display of an image on a screen of said image display apparatus in response to the plurality of electron beams focused by said focusing electrode means.

11. A flat configuration image display apparatus as claimed in claim 10, wherein said electron beam generation means, said electron beam control electrode means and said electron beam extraction means are integrally constructed with insulating members being interposed therebetween.

12. A flat configuration image display apparatus as claimed in claim 10, wherein said electron beam generation means including a plurality of base electrodes each of which has a predetermined configuration extending in a vertical direction of said screen of said image display apparatus and which are successively arranged with a predetermined pitch in a horizontal direction of said screen of said image display apparatus, said cold cathodes being formed on said base electrodes.

13. A flat configuration image display apparatus as claimed in claim 10, wherein each of said electron beam control electrode means and said electron beam extraction means has through-holes formed in correspondence with the positions of said cold cathodes.

14. A flat configuration image display apparatus as claimed in claim 10, wherein electron beams control electrode means comprises control electrodes which are successively arranged with a predetermined pitch in a vertical direction of said screen of said image display apparatus.

15. A flat configuration image display apparatus as claimed in claim 10, wherein said focusing electrode means has through-holes each of which has a size corresponding to an area occupied by a predetermined number of said cold cathodes.

16. A flat configuration image display apparatus as claimed in claim 15, wherein said focusing electrode means is positioned at portions other than said through-holes and is connected through insulating members to an optically transparent faceplate of said image display apparatus and further to said electron beam extraction means.

17. A flat configuration image display apparatus as claimed in claim 10, wherein said fluorescent film means includes black insulating portions each having a predetermined pattern, said fluorescent surface being provided at portions other than said black insulating portions.

18. A flat configuration image display apparatus as claimed in claim 10, wherein:

said electron beam generation means includes a plurality of base electrodes each of which has a predetermined configuration extending in a vertical direction of said screen of said image display apparatus;

each of said base electrodes includes a plurality of n electrically isolated segments wherein n is an integer greater than 2, said gate electrodes are divided to n interspersed groups, and including a plurality of n buses each respectively connected to one of said n groups of gate electrodes.

* * * * *

UNITED STATES PATENT AND TRADEMARK OFFICE

CERTIFICATE OF CORRECTION

PATENT NO. : 5,160,871

DATED : November 3, 1992

INVENTOR(S) : Kaoru TOMII et al

It is certified that error appears in the above-identified patent and that said Letters Patent is hereby corrected as shown below:

On the title page, item [30], under Foreign Priority Application Data as follows:

Change "1-156451" to --1-156541--.

Signed and Sealed this

Twelfth Day of October, 1993

Bruce Lehman

*Attest:*

BRUCE LEHMAN

*Attesting Officer*

*Commissioner of Patents and Trademarks*